US006051816A

United States Patent [19]

Wilkins

[11] Patent Number: 6,051,816

[45] Date of Patent: Apr. 18, 2000

[54] RADIANT ELECTRIC HEATER

[75] Inventor: Peter Ravenscroft Wilkins, Droitwich, United Kingdom

[73] Assignee: Ceramaspeed Limited, United Kingdom

[21] Appl. No.: 09/266,114

[22] Filed: Mar. 11, 1999

[30] Foreign Application Priority Data

Mar. 26, 1998 [GB] United Kingdom ..... 9806372

[51] Int. Cl.[7] ..... H05B 3/68

[52] U.S. Cl. ..... 219/448.19; 219/460.1

[58] Field of Search ..... 219/448.19, 460.1, 219/461.1, 462.1, 468.1, 468.2; 126/39 J, 90 A, 92 AC, 92 A

[56] References Cited

U.S. PATENT DOCUMENTS

| | | | |
|---|---|---|---|
| 4,430,558 | 2/1984 | McWilliams | 219/448.19 |
| 4,577,176 | 3/1986 | Bayer | 219/448.19 |
| 5,049,726 | 9/1991 | Higgins et al. | 219/460.1 |
| 5,171,973 | 12/1992 | Higgins | 219/462.1 |
| 5,204,510 | 4/1993 | McWilliams et al. . | |
| 5,270,519 | 12/1993 | Higgins | 219/448.19 |
| 5,393,958 | 2/1995 | Gross et al. | 219/461.1 |
| 5,489,764 | 2/1996 | Mannuss et al. | 219/448.19 |

FOREIGN PATENT DOCUMENTS

| | | |
|---|---|---|
| 190178 | 11/1923 | United Kingdom . |
| 538543 | 8/1941 | United Kingdom . |
| 2147328 | 9/1985 | United Kingdom . |

OTHER PUBLICATIONS

Search Report Aug. 28, 1998.

*Primary Examiner*—Sang Paik
*Attorney, Agent, or Firm*—Ira S. Dorman

[57] ABSTRACT

A radiant electric heater includes a base (2) of thermal and electrical insulation material and at least one electrical heating element (4) supported on a surface (3) of the base. A rod-like temperature-responsive device (10) extends across the heater from a periphery and is spaced from the electrical heating element (4). The rod-like temperature-responsive device (10) extends only partly across the heater and the surface (3) of the base (2) has a substantially continuous concave profile, at least where the at least one heating element (4) is supported, for accommodating an end region (12) of the device.

22 Claims, 1 Drawing Sheet

FIG 1
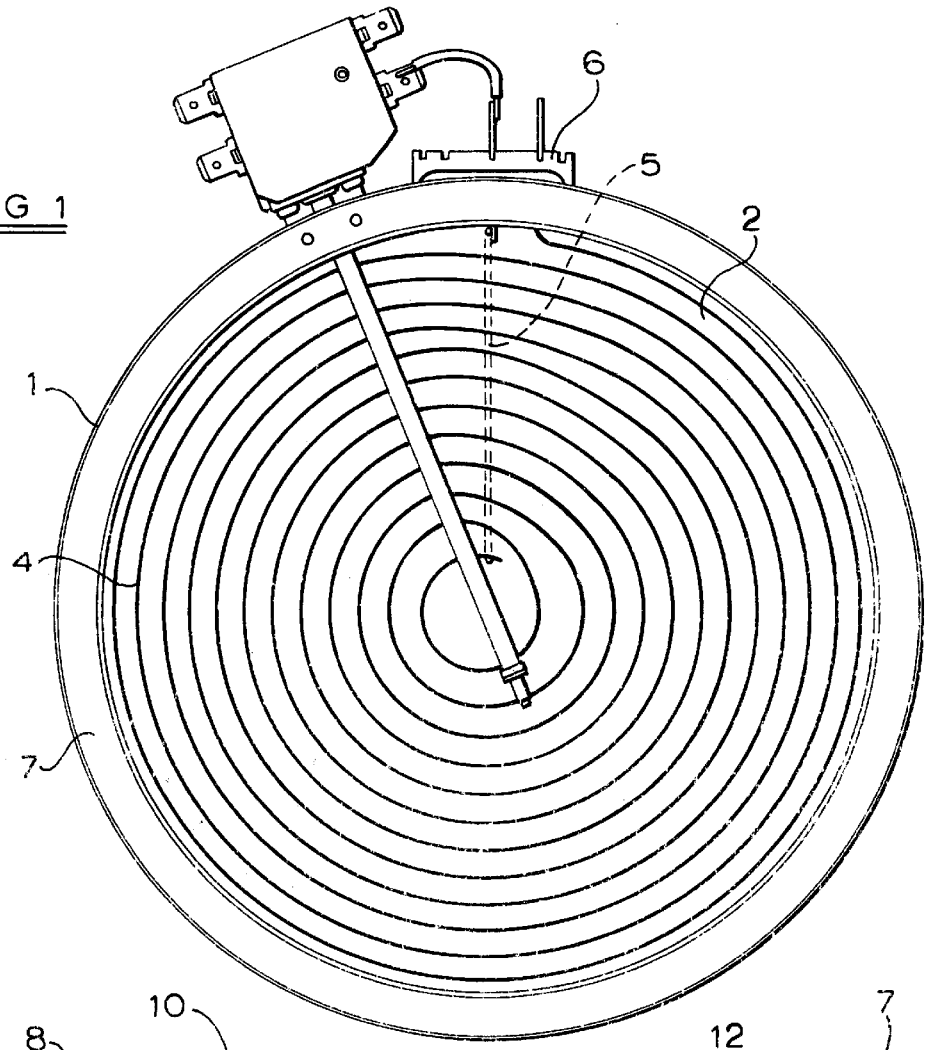
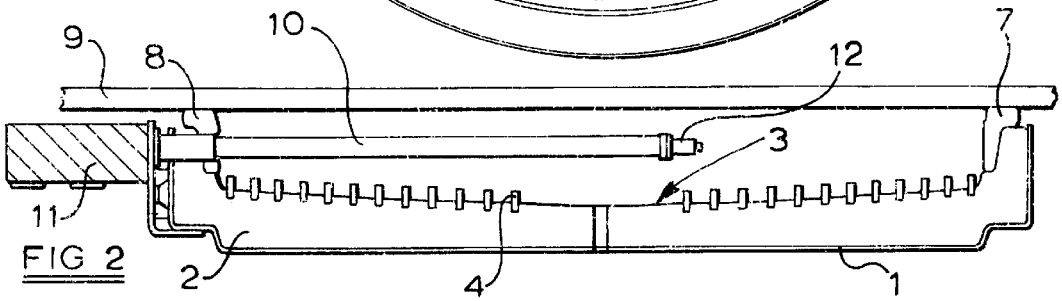
FIG 2
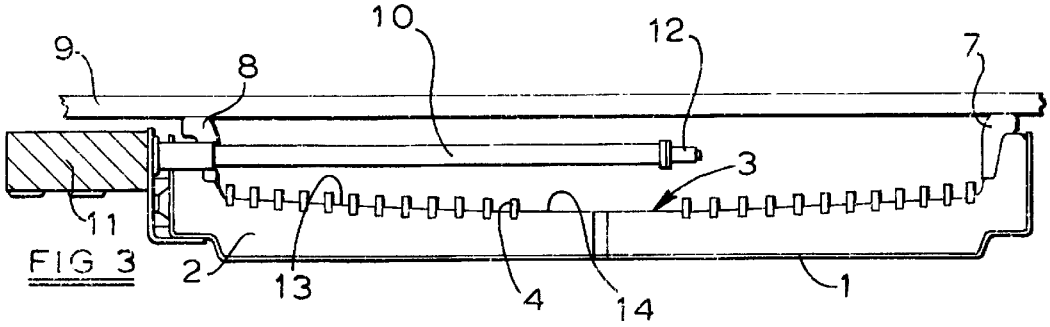
FIG 3

RADIANT ELECTRIC HEATER

This invention relates to radiant electric heaters, particularly but not exclusively for use in cooking appliances, such as glass-ceramic cooking appliances.

BACKGROUND TO THE INVENTION

Radiant electric heaters are well known comprising a base of thermal and electrical insulation material, such as microporous insulation material, having supported thereon at least one electric heating element such as of bare wire or ribbon form. The base of insulation material can be provided in a dish-like support, such as of metal. The base has a flat surface and/or may be formed in discontinuous sections. A wall of thermal insulation material is provided around the periphery of the heater and an upper surface of the wall is arranged to contact the underside of a glass-ceramic cooking plate.

It is usual to provide a rod-like temperature-responsive device extending at least partly across the heater, between the heating element or elements and the glass-ceramic plate and arranged substantially parallel to the glass-ceramic plate. Such temperature-responsive device is arranged to de-energise the heater at a predetermined sensed temperature to prevent overheating of the glass-ceramic plate.

Increasing use is being made of rod-like temperature-responsive devices which extend only partly across the heater and which have an end located in a middle region of the heater. Such temperature-responsive devices may comprise a metal rod of relatively high thermal expansion inside a tube of relatively low thermal expansion. The tube is generally of electrical insulating material, such as quartz or fused silica, or a ceramic such as cordierite. The rod and tube are mechanically connected at the end which is located in the middle region of the heater and a metal component is generally exposed at this end location.

The heating element or elements is or are normally supported on a flat surface of the base of insulation material, for example in a plane parallel to that of the glass-ceramic plate.

With this arrangement the metal component at the end of the rod-like temperature-responsive device may be in close proximity to the one or more heating elements and this is particularly so when the element or elements is or are provided directly underlying the end of the device such as, for example, when the element or elements is or are provided in spiral form from the periphery of the heater to the middle of the heater.

A problem arises with such an arrangement in that electrical safety legislation sets down limits for the minimum distance between the heating element or elements, that may be of live electrical potential, and neighbouring metal components, that are of zero electrical potential or connected to earth, such as the metal component at the end of the rod-like temperature-responsive device. Furthermore, heater manufacturers are under pressure to provide heaters which are compact and with as low a profile as possible, such that the distance between the heating element and the glass-ceramic is as small as possible.

OBJECT OF THE INVENTION

It is an object of the present invention to overcome or minimise this problem.

SUMMARY OF THE INVENTION

According to the present invention there is provided a radiant electric heater comprising a base of thermal and electrical insulation material having a surface supporting at least one electrical heating element and a rod-like temperature-responsive device extending across the heater from a periphery thereof and spaced from the at least one electrical heating element, wherein the rod-like temperature-responsive device extends only partly across the heater and the surface of the base has a substantially continuous concave profile, at least where the at least one heating element is supported, for accommodating an end region of the device.

The concave profile may be substantially in the form of a section of an interior of a sphere or substantially in the form of an inverted shallow cone, preferably truncated.

The heater may be provided with a peripheral wall of thermal insulation material having a surface for contacting a plate, such as of glass-ceramic material, the rod-like temperature-responsive device being arranged substantially parallel to the plane of the surface of the peripheral wall.

The end region of the rod-like temperature-responsive device, remote from the periphery of the heater, may be located at a greater distance from the surface of the base than a region of the device nearer the periphery of the heater.

The end region of the rod-like temperature-responsive device remote from the periphery of the heater may be located substantially in the vicinity of a region of maximum concave depression of the surface of the base.

At least the end region of the temperature-responsive device remote from the periphery of the heater may comprise a metal.

At least the end region of the temperature-responsive device remote from the periphery of the heater may overlie the at least one electrical heating element.

The at least one electrical heating element may be arranged substantially in the form of a spiral.

The at least one electrical heating element may comprise a bare wire or ribbon element.

When the at least one electrical heating element comprises a ribbon, this may be supported on edge and secured by partial embedding in the surface of the base.

The base may comprise microporous thermal and electrical insulation material.

As a result of the concave surface profile of the base, the end region of the temperature-responsive device remote from the periphery of the heater can be at a greater distance from the underlying heating element or elements than would be the case with a flat or planar surface of the base. Any metal at the remote end region of the device can therefore be located at a safe distance from the heating element or elements.

It is to be understood that the expression "substantially continuous concave profile" used herein is intended to cover not only a profile corresponding to a shallow section of the interior of a sphere but also other substantially similar shallow forms which may, for example, be more practical to produce. Such other forms include an inverted shallow cone, preferably truncated, which because of its shallowness creates a similar profile to the section of a sphere but is more readily provided at the surface of the base of insulation material.

The invention is now described by way of example with reference to the accompanying drawings in which:

BRIEF DESCRIPTION OF THE DRAWINGS

FIG. 1 is a plan view of a radiant electric heater of the invention;

FIG. 2 is a cross-sectional view of the heater of FIG. 1; and

FIG. 3 is an alternative cross-sectional view of the heater of FIG. 1.

DESCRIPTION OF PREFERRED EMBODIMENT

A radiant electric heater is constructed comprising a metal dish-like support 1 having therein a base layer 2 of microporous thermal and electrical insulation material, such material being well known to the skilled person. The base layer 2 has a surface 3 supporting an electrical heating element 4 providing a heated area within the heater. The heating element 4 comprises a well known form of bare corrugated ribbon supported edgewise on the surface 3 and secured by partial embedding therein. Other forms of heating element could be provided, such as bare wire, particularly in coiled form. A plurality of heating elements could be provided if required.

The heating element 4 is arranged in the form of a spiral extending from a middle region of the heater to a periphery thereof. An electrical lead 5 is provided, connecting between the inner end of the spiral form heating element 4 and a terminal block 6 at the edge of the heater.

A peripheral wall 7 of thermal insulation material is provided in the heater and has an upper surface 8 contacting the rear (lower as illustrated in the figures) surface of a glass-ceramic cooking plate 9.

A well known form of rod-like temperature-responsive device 10 is provided extending partly across the heater from the periphery thereof. The device 10 operates as a temperature limiter to prevent overheating of the glass-ceramic plate 9 and comprises a differentially-expanding rod-in-tube assembly, operating a switch mechanism 11 at a predetermined temperature to de-energise the heater. The rod and tube assembly of the device 10 typically comprises a metal rod inside a tube of quartz or fused silica or of a ceramic such as cordierite. The rod and tube are joined together at the end remote from the switch 11 by means of a metal component 12.

It is important that the metal component 12 is maintained at a specified safe distance from the bare live heating element 4. In order to ensure this, the surface 3 of the base layer 2 of insulation material is arranged to have a substantially continuous concave profile, the heating element being partially embedded in this profiled surface.

As seen in FIG. 2, the surface 3 is profiled in the form of a section of an interior of a sphere of relatively large radius, resulting in a substantially continuous shallow concave depression, the lowest point of which substantially coincides with the centre of the heated area of the heater. However, as such true spherical sections may be difficult to achieve in practice, an arrangement as shown in FIG. 3 may be preferred. In FIG. 3, the surface 3 is profiled in the form of an inverted truncated shallow cone (the axis of which substantially coincides with the centre of the heated area of the heater), providing in effect a sloping shallow conical section 13 of shallow angle, truncated to provide a substantially flat base portion 14. Because of its shallowness, the resulting effect is of a substantially continuous concave profile similar to that of the section of the interior of the sphere as shown in FIG. 2.

As a result of the concave surface profile 3 on which the heating element 4 is supported, the distance between the metal component 12, at the end of the temperature-responsive device 10, and the underlying heating element 4 is increased, compared with the use of a flat, or a discontinuous, surface of the prior art. The end region 12 of the temperature-responsive device is located substantially in the vicinity of a region of maximum, albeit shallow, concave depression of the surface of the base 2. In the arrangement of FIG. 3, this is readily ensured by appropriate selection of the dimensions of the substantially flat base portion 14 of the profiled surface, according to the length of the temperature-responsive device 10 being used.

I claim:

1. A radiant electric heater comprising a base of thermal and electrical insulation material having a surface supporting at least one electrical heating element and a rod-like temperature-responsive device extending across the heater from a periphery thereof and spaced from the at least one electrical heating element, wherein the rod-like temperature-responsive device extends only partly across the heater, wherein the surface of the base has a substantially continuous concave profile, at least where the at least one heating element is supported, for accommodating an end region of the temperature-responsive device, and wherein the lowest point of the concave profile substantially coincides with a centre of a heated area of the heater.

2. A heater according to claim 1, wherein the concave profile is substantially in the form of a section of an interior of a sphere.

3. A heater according to claim 1, wherein the concave profile is substantially in the form of an inverted shallow cone.

4. A heater according to claim 3, wherein the shallow cone is truncated.

5. A heater according to claim 1, wherein a peripheral wall of thermal insulation material is provided, the peripheral wall having a surface, lying substantially on a plane for contacting a plate, the rod-like temperature-responsive device being arranged substantially parallel to the plane of the surface of the peripheral wall.

6. A heater according to claim 5, further including a glass-ceramic plate disposed in contact with the surface of the peripheral wall.

7. A heater according to claim 1, wherein the end region of the temperature-responsive device, remote from the periphery of the heater, is located at a greater distance from the surface of the base than a region of the device nearer the periphery of the heater.

8. A heater according to claim 1, wherein the end region of the temperature-responsive device remote from the periphery of the heater is located substantially in the vicinity of a region of maximum concave depression of the surface of the base.

9. A heater according to claim 1, wherein at least the end region of the temperature-responsive device remote from the periphery of the heater comprises a metal.

10. A heater according to claim 1, wherein at least the end region of the temperature-responsive device remote from the periphery of the heater overlies the at least one electrical heating element.

11. A heater according to claim 1, wherein the at least one electrical heating element is arranged substantially in the form of a spiral.

12. A heater according to claim 1, wherein a distance between the rod-like temperature-responsive device and the at least one heating element increases progressively with increasing distance from the periphery of the heater towards a centre region thereof.

13. A radiant electric heater comprising a base of thermal and electrical insulation material having a surface supporting at least one electrical heating element and a rod-like temperature-responsive device extending across the heater from a periphery thereof and spaced from the at least one electrical heating element, wherein the rod-like temperature-responsive device extends only partly across the heater, wherein the surface of the base has a substantially continuous concave profile, at least where the at least one heating element is supported, for accommodating an end region of the device, wherein the lowest point of the concave profile substantially coincides with a centre of a heated area of the heater, and wherein a distance between the rod-like temperature-responsive device and the at least one heating element increases progressively with increasing distance from the periphery of the heater towards a centre region thereof.

14. A heater according to claim 13, wherein the concave profile is substantially in the form of a section of an interior of a sphere.

15. A heater according to claim 13, wherein the concave profile is substantially in the form of an inverted shallow cone.

16. A heater according to claim 15, wherein the shallow cone is truncated.

17. A heater according to claim 13, wherein a peripheral wall of thermal insulation material is provided, the peripheral wall having a surface, lying substantially on a plane, for contacting a plate, the rod-like temperature-responsive device being arranged substantially parallel to the plane of the surface of the peripheral wall.

18. A heater according to claim 17 further including a glass-ceramic plate disposed in contact with the surface of the peripheral wall.

19. A heater according to claim 13, wherein the end region of the temperature-responsive device remote from the periphery of the heater is located substantially in the vicinity of a region of maximum concave depression of the surface of the base.

20. A heater according to claim 13, wherein at least the end region of the temperature-responsive device remote from the periphery of the heater comprises a metal.

21. A heater according to claim 13, wherein at least the end region of the temperature-responsive device remote from the periphery of the heater overlies the at least one electrical heating element.

22. A heater according to claim 13, wherein the at least one electrical heating element is arranged substantially in the form of a spiral.

* * * * *